US007959541B2

(12) United States Patent
Jung

(10) Patent No.: US 7,959,541 B2
(45) Date of Patent: Jun. 14, 2011

(54) CRUSHING SQUISH BALL

(76) Inventor: Man-Young Jung, Pasadena, CA (US)

( * ) Notice: Subject to any disclaimer, the term of this patent is extended or adjusted under 35 U.S.C. 154(b) by 360 days.

(21) Appl. No.: 12/217,694

(22) Filed: Jul. 8, 2008

(65) Prior Publication Data

US 2010/0009817 A1 Jan. 14, 2010

(51) Int. Cl.
*A63B 21/00* (2006.01)

(52) U.S. Cl. ..... 482/49; 482/44

(58) Field of Classification Search ..... 473/572, 473/594, 593, 612; 482/49, 44, 22, 21, 20
See application file for complete search history.

(56) References Cited

U.S. PATENT DOCUMENTS 5,000,451 A * 3/1991 MacDonald et al. ..... 473/594
6,863,588 B1 * 3/2005 Chu ..... 446/487
6,896,577 B1 * 5/2005 Feng ..... 446/486

* cited by examiner

*Primary Examiner* — Jerome W Donnelly
(74) *Attorney, Agent, or Firm* — Clement Cheng

(57) ABSTRACT

An ultra light but resistive ball device for exercise is provided comprising: a flexible sheet with least one preliminary broken section of collapse for allowing contraction of the sheet under bias about at least one flex point in response to an exertion of hand grip. The sheet has two free ends extending substantially half the circumference of the ball and partially folded back on the sheet. Two lateral apertures are located at opposite ends of the free ends to permit an uninterrupted collapse of the sheet. A sheath envelopes the sheet to provide a slip resistant exterior surface for grasping the ball.

11 Claims, 6 Drawing Sheets

CRUSHING SQUISH BALL

BACKGROUND OF THE INVENTION

A. Field of the Invention

The present invention relates to an exercise device. More particularly, the present invention relates to safe impact ball for exercising hand grip as well as practicing ball skill between players.

B. Description of the Prior Art

Traditional balls used in recreational games and competition sports are closed spheres or ovoids inflated with air. Besides being hit, kicked, thrown and rolled between multiple players, when the balls are used as an individual's exercise tool they can improve the exerciser's muscle power, responsiveness and speed through catching and squeezing among other activities.

For this purpose, different materials have been introduced to simulate the flexibility, bounce or texture of the conventional inflated balls in the category of novelty balls. They are gel-filled squeeze balls, ball shaped foam or simply a tennis ball that yields to a rather high strength hand squeeze. Gelatinous balls and foam balls have been considered more desirable in that they can be made solid simply by pouring the respective materials into a round mold cavity or through cutting and are carefree from maintaining a hollow center to fill.

Gel-filled balls in the size of a baseball for example may provide an effective resistance to make a good grip exerciser, but in the hands of young ones they could easily become throwing objects that may hit someone hard resulting in injury. In contrast, a solid foam ball may be almost as light as air due to its perforated structure but lacks the material resistance to give a meaningful muscular improvement to the exerciser. Also, foam balls are normally made into a larger volume to gain a throwing momentum for old and new ball throwing games with less concern for injuries.

Furthermore, conventional squish balls locally yield to applied forces but do not actually change their volumes in an intuitive manner to effect shrinkage and expansions in response to contracting and spreading hands during exercise.

Therefore, an object of the present invention is to provide a new concept of a hand exercise device with the curvature of a ball and the lightness of thin layers but carries the resistance of an inflated ball to interact with hand muscles.

Another object of the present invention is to provide a low cost exerciser device made of a single piece of thin expanded sheet molded into a spherical shrinkable surface.

SUMMARY OF THE INVENTION

According to the present invention, an ultra light but resistive ball device for exercise is provided. The ball device comprises a flexible sheet with least one preliminary broken section of collapse for allowing contraction of the sheet under bias about at least one flex point in response to an exertion of hand grip. The ball device is of a ball shape which could resemble a baseball, a football, or a basketball. The term 'ball shape' therefore refers to shapes of commonly known balls.

The sheet has two free ends extending substantially half the circumference of the ball and partially folded back on the sheet. Two lateral apertures are located at opposite ends of the free ends to permit an uninterrupted collapse of the sheet. A sheath envelops the sheet to provide a slip resistant exterior surface for grasping the ball. The sheet may be made of steel, plastic or other material that is suitable to provide an excellent spring bias as well as structurally reliable shape of the ball. The sheath is preferably made of silicon for its heat resistance and good grip.

The two free ends may be are positioned diametrically opposite locations of the circumference of the ball. In one embodiment, the sheet has two hemispherical sections and an integral bias bridge for internally joining the hemispherical sections in diametrically opposite postures into a spherical form. The sheet is preferably either spherical or ovoid although other shapes may adapt well to embody the present invention.

In a simpler embodiment of the present invention, the two free ends are overlapped over a predetermined circumferential area of the ball and have a common flex area in between the free ends. The resistive ball further comprises a tracking means having a number of grooves extending circumferentially and internally of the sheet from an outer one of the free ends down to the bottom of the sheet and elongated raised treads near the other inner free end for mating with the grooves so that the treads may follow the grooves in linear fashion to guide the ball contract and expand in straight response to gripping forces.

Embodiments of the invention will now be described by way of example with reference to the accompanying drawings.

BRIEF DESCRIPTION OF THE DRAWINGS

Similar reference numbers denote corresponding features throughout the attached drawings.

| | | |
|---|---|---|
| 10: Ball Device | 11: Elastic Cover | 12: Cage |
| 14: Cage Upper | 16, 26: Free End | 18: Equitorial Plane |
| 20, 28: Proximal End | 22: Cage Lower | 24: Bridge |
| 30: End Hook | 32: Rounded Edge | 33: Raised Wall |
| 34: Axial Aperture | 36, 38: Semicircular Recess | 40, 42: Curved End |
| 43: Cage Blank | 45: Cage Half | 46: Cage Section |
| 100: Ball Device | 102: Cage | 104: Outer Edge |
| 106: Inner Edge | 107: Rolled End | 108: Groove |
| 110: Tread | 112: Sheath | 116: Tubular Form |
| 118: Blower Head | A: Axis | |

DETAILED DESCRIPTION OF THE PREFERRED EMBODIMENT

Figure 1:
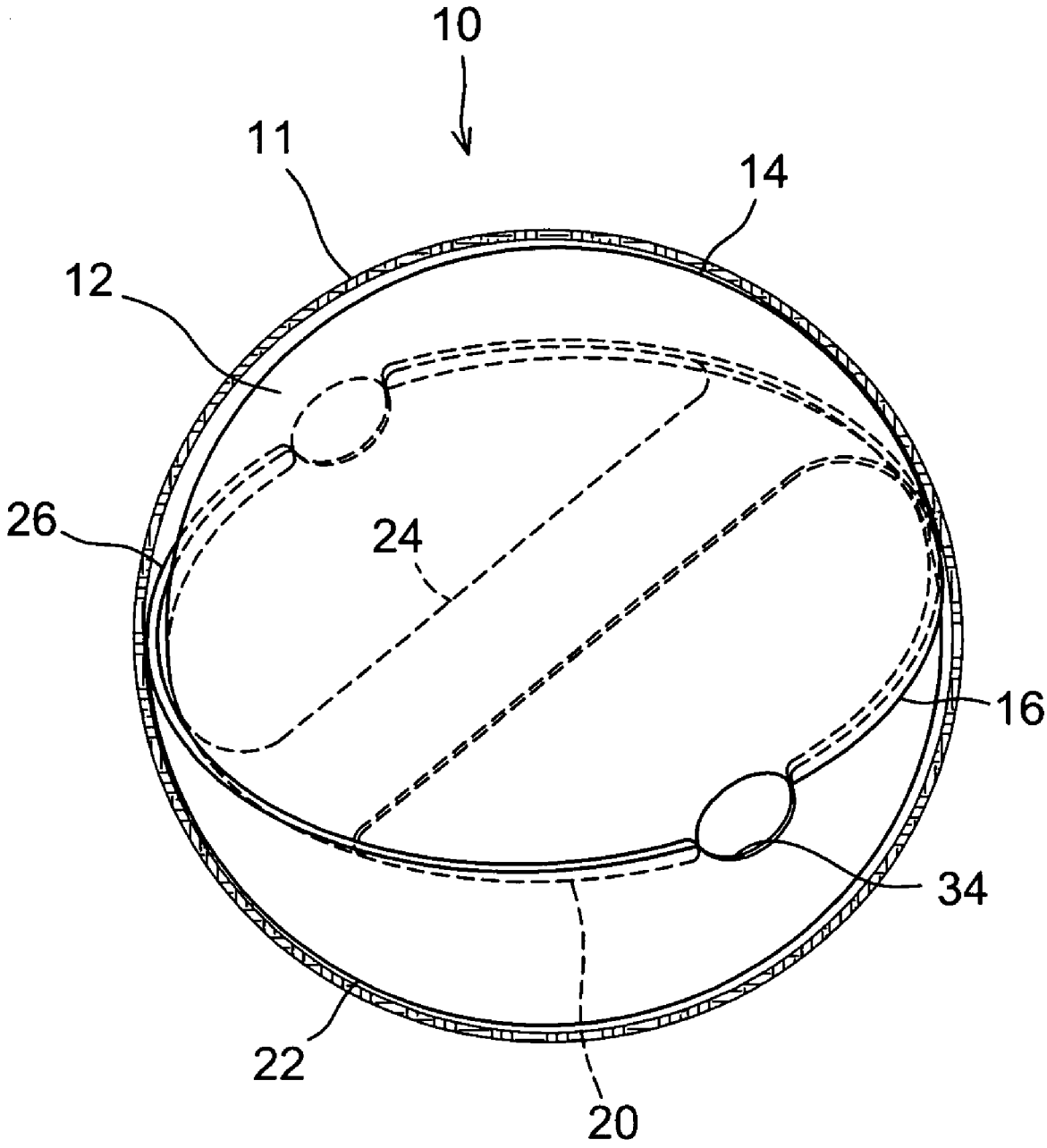
FIG. 1 is a perspective view of a crushing squish ball according to one embodiment of the present invention.

With reference to FIG. 1, an exercising ball device 10 according to the present invention is a spherical hand spring with rounded walls that are smooth and easy surfaces to touch. Ball device 10 comprises an elastic cover 11 with a gripping surface finish and a spherical cage 12 that may be resiliently compressed by hands grip. Cage 12 may be made of a light and sturdy sheet material such as thermoformable plastic or sheet metal. Such sheet material may be either solid or perforated as long as it provides the necessary spring for a grip exercise. Being a modified spring mechanism of solid walls, cage 12 has a range of motion under its own bias within the confinement of a dynamic sphere. Cage 12 is a ball, which is open along two diametrically opposite circumferential sections where free distal ends trail its opposite proximal ends.

Figure 2:
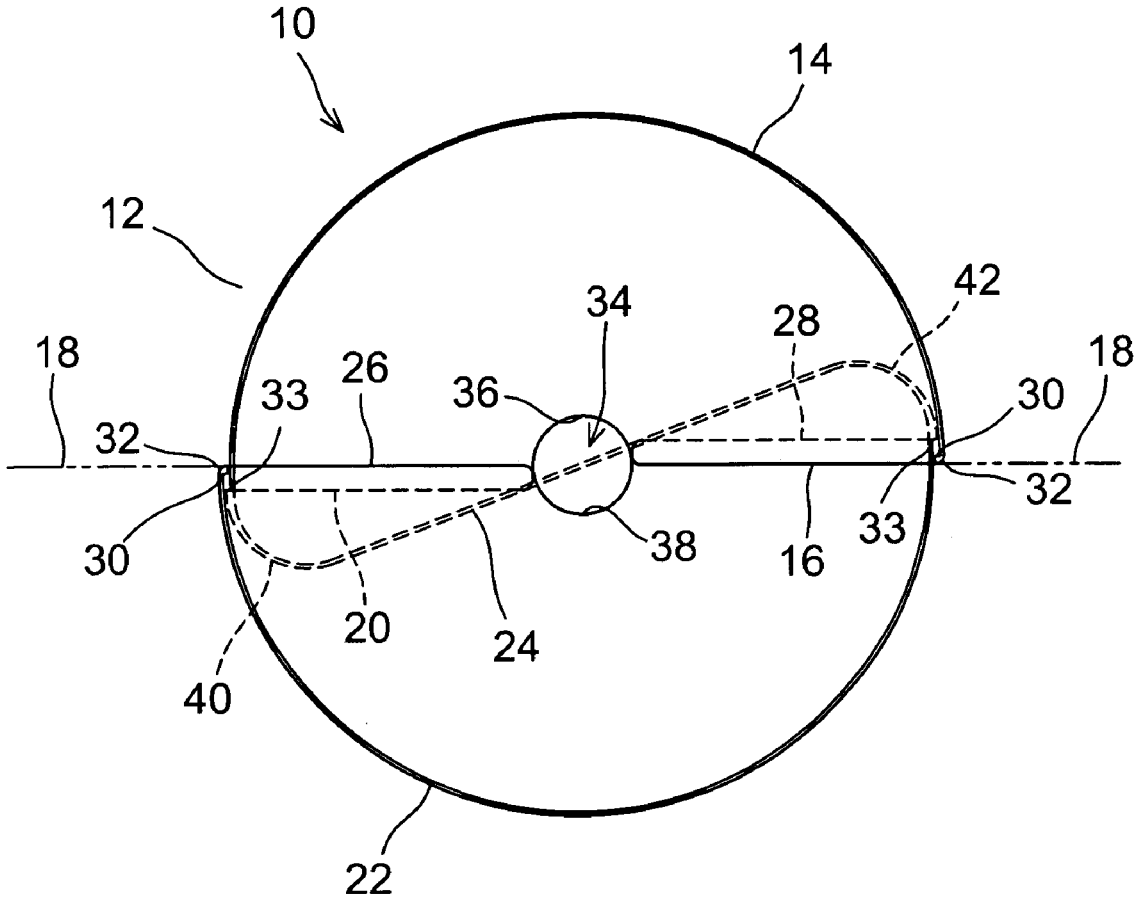
FIG. 2 is a side view of the squish ball of FIG. 1.

Referring to FIG. 2 of a side view of cage 12, this embodiment is an S-shaped double spring in which one of two hemispherical spring levers forms a cage upper 14 that starts from a free end 16 extending along approximately one half of the circumference of cage 12. Normally, free end 16 may fall on an imaginary equatorial plane 18 intersecting the center of the sphere of cage 12 but the opposite proximal end 20 spanning approximately the rest circumferential half may extend past the equatorial plane 18. This stepped profile may assist in fully interconnecting cage upper 14 always with a hemispherical cage lower 22, which is formed diametrically symmetrical to cage upper 14. Formed integral to cage upper 14 through an internal connection bridge 24, the cage lower 22 has a free end 26 in the equatorial plane 18 encircling distal end 20 of cage upper 14 and a proximal end 28 terminating cage lower 22 inside free end 16 of cage upper 14. Therefore, two cage halves 14 and 22 constantly maintain a secure interconnection by the oppositely protruding proximal ends 20 and 28, which are received in opposite distal ends 16 and 20 on the same equatorial plane 18. In addition, to help cage 12 maintain its sphere, a stop means may be provided to limit sliding movement of cage halves 14 and 22 away from each other. For this purpose, the free ends 16 and 26 may be slightly convoluted to form inward end hooks 30 while providing rounded exterior edges 32. Facing end hooks 30, proximal ends 20 and 28 have raised walls 33 for abutting against free ends 16 and 26 to complete the stop means.

A round axial aperture 34 may be made cooperatively by two sets of semicircular recesses 36 and 38 formed at the transitions between free ends 16, 26 and basal ends 20, 28. These transitional apertures 34 allow upper and lower cage halves 14, 22 to crisscross while accommodating forced deflections of cage halves 14, 22 over each other. Like the rest of cage 12, bridge 24 is flexible in connecting the upper 14 and lower 22 and thus it may deform to absorb a crushing force exerted unto cage 12. Bridge 24 is connected to proximal ends 20 and 28 of cage upper and lower 14 and 22 via oppositely curved ends 40 and 42 to initiate a linear yielding deformation of bridge 24 in direct response to hands squeezes.

Figure 3:
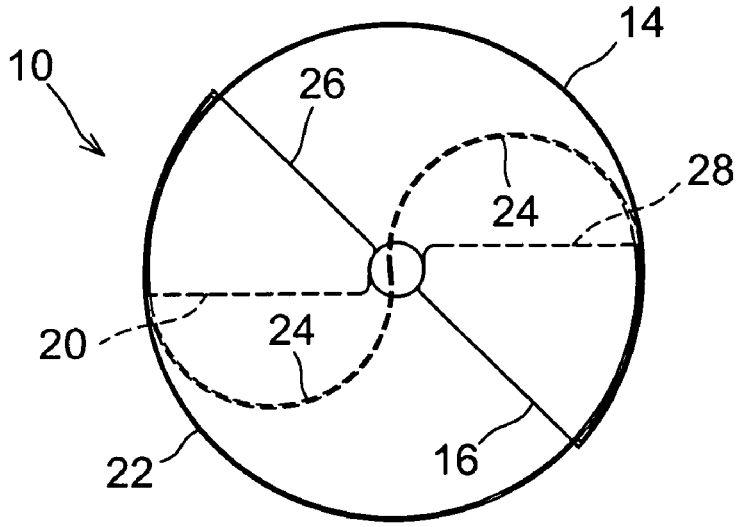
FIG. 3 is a schematic side view of the squish ball compressed under a grasping force.

As shown in FIG. 3 where ball 10 is halfway squeezed, bridge 24 may be deformed into large "S" and both cage halves 14, 22 recede to make a smaller diameter of cage 12 under bias. In this state of contraction, cage 12 may be wrapped by elastic cover 11 that has at least one opening corresponding to aperture 34. Then, an appropriate surface pattern of irregularities may be applied by a coating or printing method to enhance the grip of ball 10.

Figure 4:
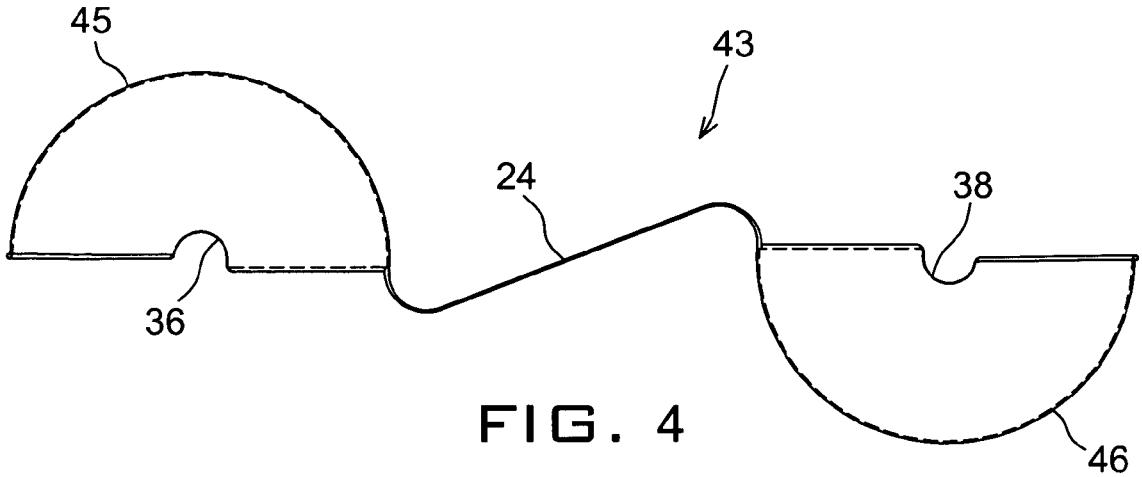
FIG. 4 is a side view of the squish ball at an initial process of forming the major components in a single step.
Figure 5:
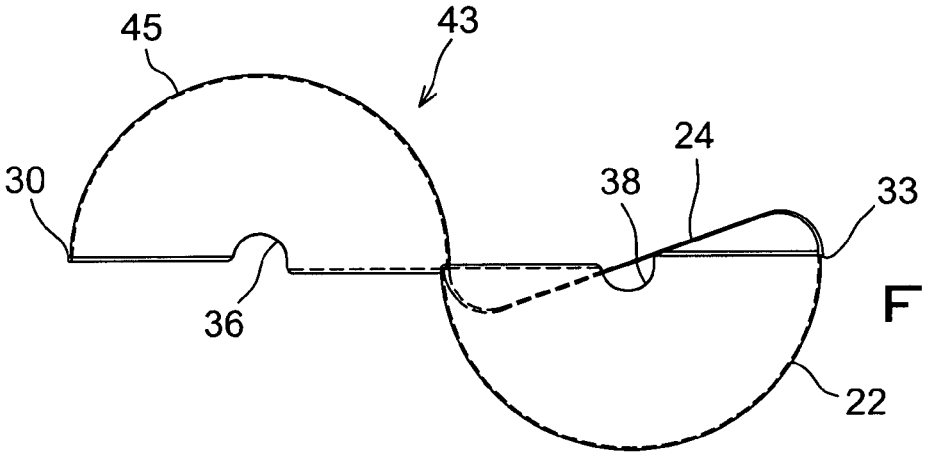
FIG. 5 is a side view of the squish ball with one of two hemispherical sections inverted with respect to a middle connection in a second step.
Figure 6:
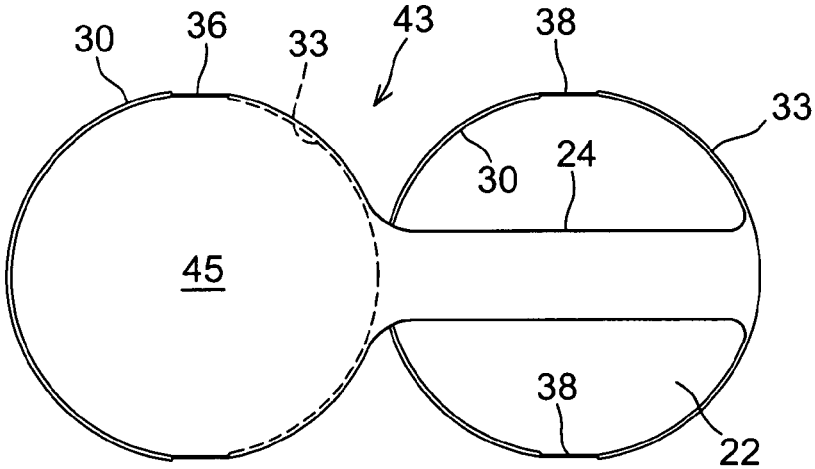
FIG. 6 is a plan view of the squish ball of FIG. 5.

FIGS. 4 and 5 illustrate steps of making the cage 12 where overhangs are substantially precluded from the structure of a preliminary cage blank 43, which may be an injection molded plastic member. Alternatively, a shaped plain sheet metal may pressed under a single deep drawing to provide the same structure of unfinished cage 43. A preformed cage half 45 is an inverted shape of cage upper 14 of finished cage 12 while an opposite cage section 46 provides cage lower 22 when it is inverted easily as depicted in FIG. 5 by hands or a mechanical pusher (not shown). In shaping cage 12, bridge 24 and curved ends 40, 42 need no machining or reshaping and may be held firmly by a stable support. FIG. 6 shows the half finished cage of FIG. 5 in plan view where bridge 24 is clear to see.

Figure 7:
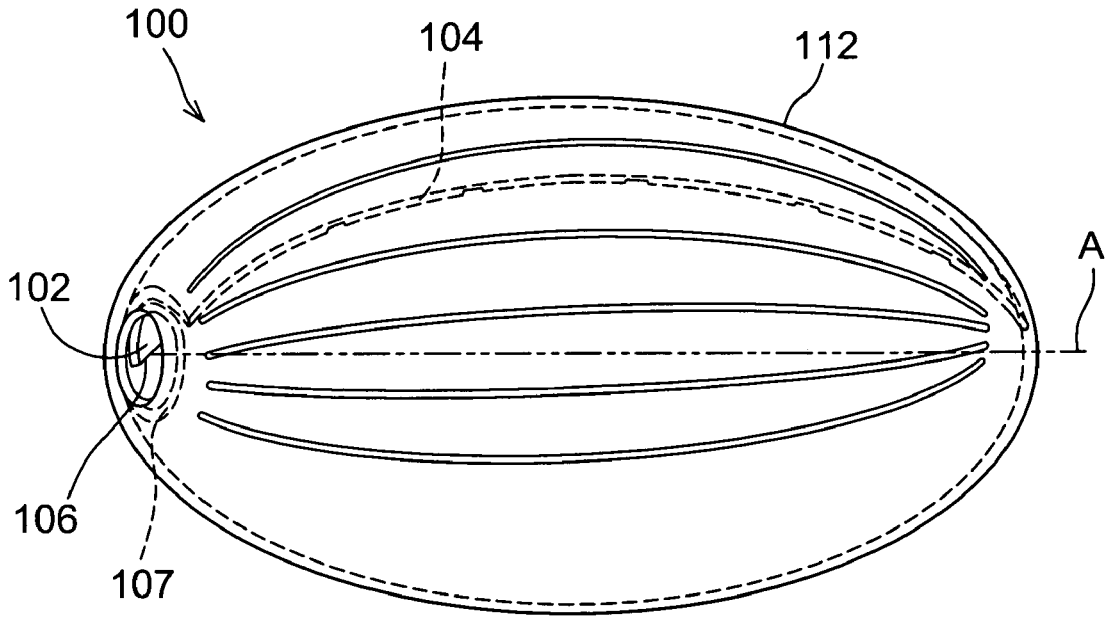
FIG. 7 is a perspective view of an ovoid squish ball according to an alternative embodiment of the present invention.

FIG. 7 shows a squish ball structure according to an alternative embodiment of the present invention. In this embodiment, a ball 100 resembles a football, which is ovoid. Besides sphere and ovoid, other various polyhedral shells may work equally well to implement the present invention. Compared to the double flex ball 10 that has two separate contraction sections, this ball 100 includes a cage 102 that shrinks at one side by a curved outer edge 104 overlaying an involuted inner edge 106 both of which extend in the direction of the longer axis A of cage 100 as well as along the surface curvature of cage 102. At both lateral sides, rolled ends 107 connect adjacent outer and inner edges 104, 106, respectively.

The cage 102 is enveloped by a sheath 112 made of a thin elastic material, which may comprise a generally smooth inner surface and an outer traction surface that has a good grip even in a wet hand. A separately formed silicone skin may provide sheath 112 sized to encapsulate cage 102 under a slight compression to keep the sheath 112 free of a slack. However, in order for the sheath 112 to accommodate a wide range of volume changes of cage 102 to under, say 50 percent of the normal girth of ball 100, a number of creases 112 may be formed in the overlapping wall area of cage 102 between edges 104 and 106. Sheath 112 may be locally fixed to cage 102 where least deformations take place such as the diametrically opposite area of the overlapping cage walls. To prevent undesirable movements between cage 102 and sheath 112, a mechanical fastening may be made by forming one or more projections from inner walls of sheath 112 and corresponding bores on cage 102 so that they mate securely at assembly.

The sheath 112 could be made of a microfiber elastic fabric material. The sheath should be light, stretchable and fitting over the cage 102.

Figure 8:
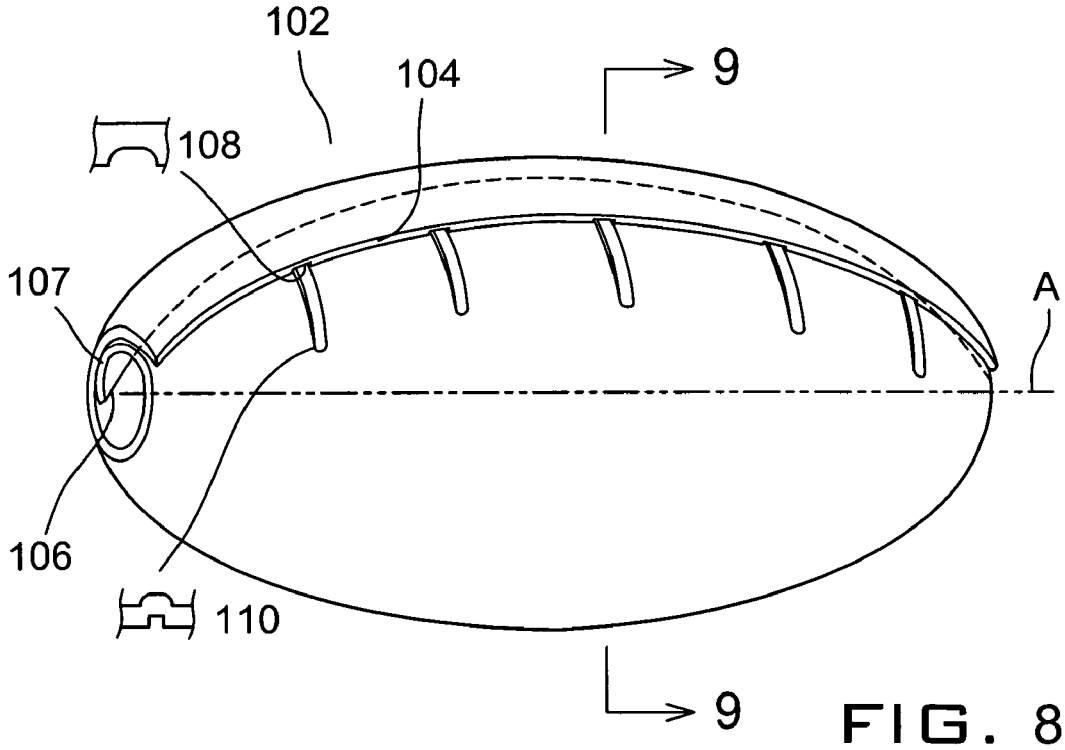
FIG. 8 is a view showing a spring cage of the ovoid ball with the covering removed.
Figure 9:
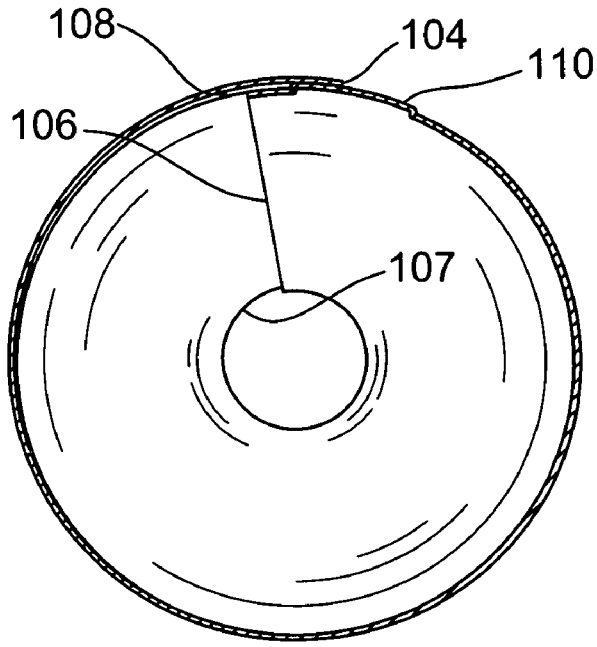
FIG. 9 is a cross sectional view of the squish ball taken along line 9-9 of FIG. 8.

Referring to FIGS. 8 and 9, cage 102 may have a tracking means comprising a number of tracks or grooves 108 extending on the inner surface from outer edge 104 about the axis A down to the bottom of cage 102 and elongated raised treads 110 near inner edge 106 for mating with grooves 108. Treads 110 may follow the linear grooves 108 to help cage 102 contract and expand in straight response to gripping forces. In addition, by reducing contact surfaces of folded ends of cage 102, the tracking means provides slick and fast actuations of ball 100 by the exerciser.

Figure 10A:
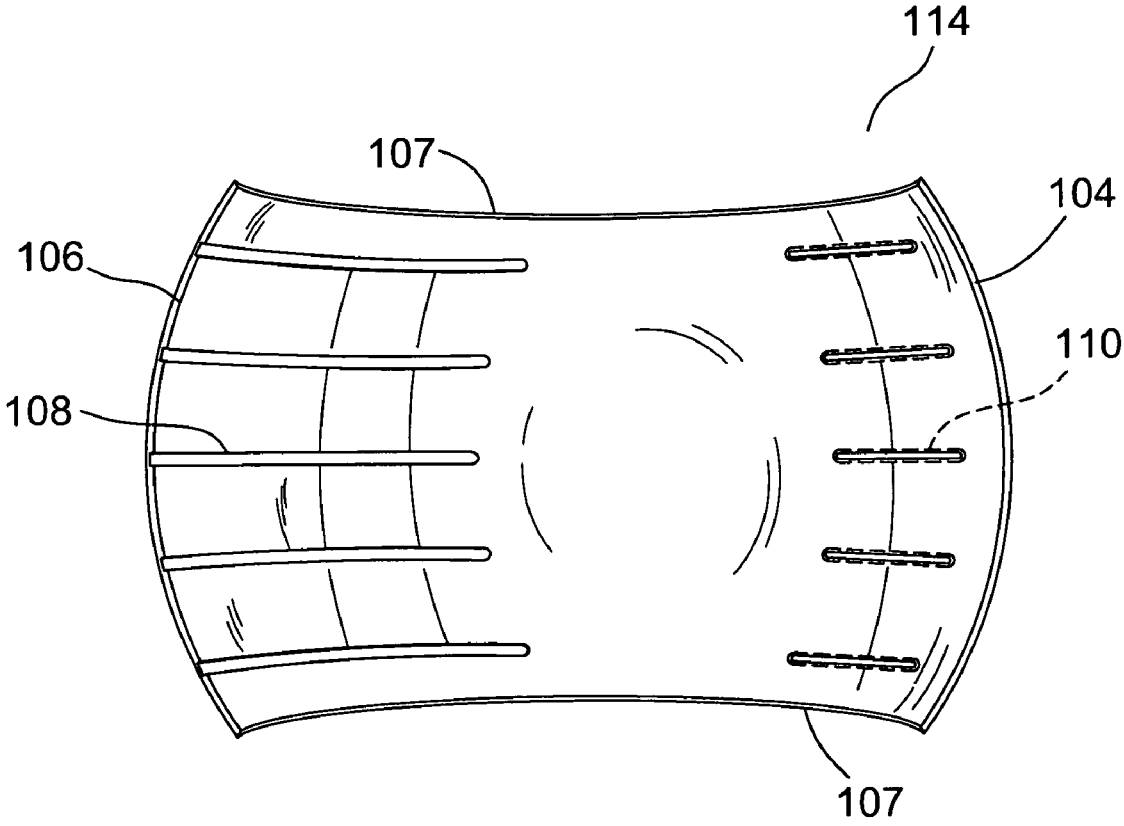
FIG. 10A is plan view of a preliminary blank of the spring cage at an initial process of forming the major features in a single step.
Figure 10B:
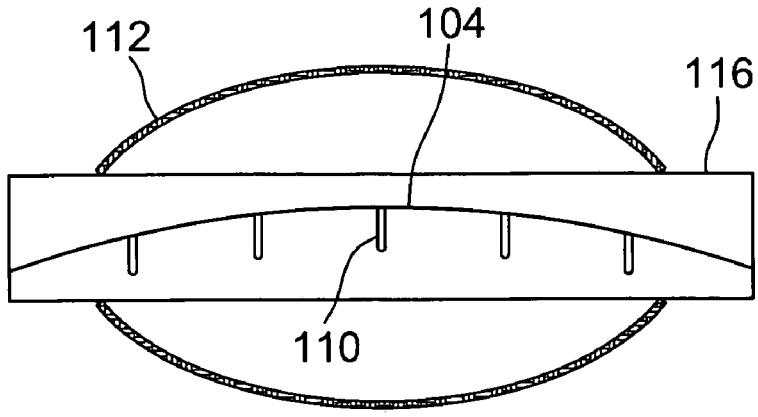
FIG. 10B is a side view of the cage blank at a process of rolling the cage and positioning a prepared sheath.
Figure 10C:
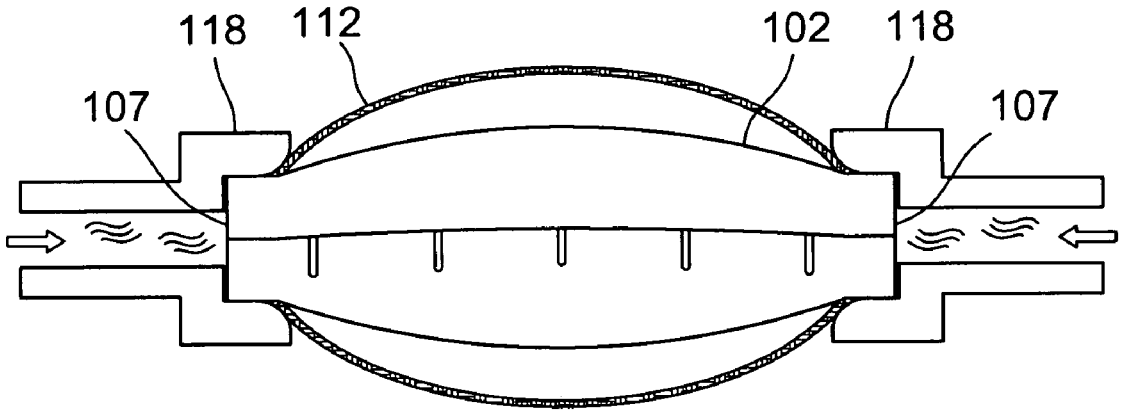
FIG. 10C is a side view of the cage blank under a blow molding process using an injected high temperature air.
Figure 10D:
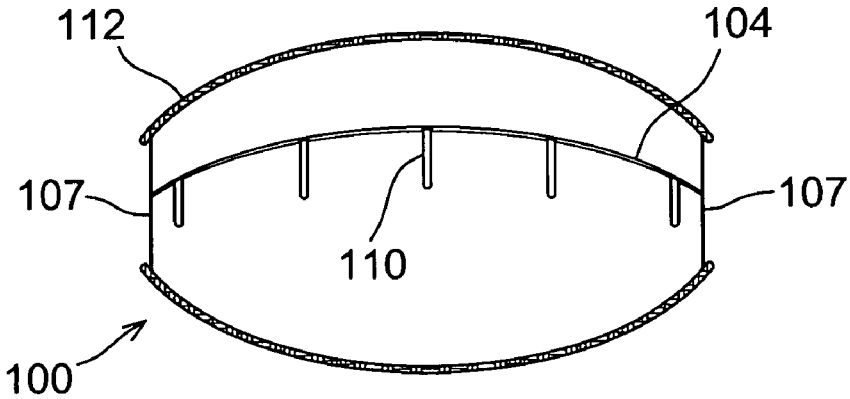
FIG. 10D is a side view of a full-blown ball device of the invention ready for use in exercising.

A method of making ball 100 is illustrated in FIG. 10 which is subdivided into FIGS. 10A through 10D. In FIG. 10A, deep drawing is used where a generally rectangular blank of either plastic or sheet metal is thermal pressed to obtain a deep hemispherical form 114 complete with the depressed grooves 108 and the embossed treads 110. Thus formed blank 114 may be rolled into a tubular form 116 as in FIG. 10B. Separate sheath 112 may be slipped over tubular form 116, which is then grasped by round blower heads 118 for injecting pressurized air of high temperature through laterally open rolled ends 107 to blow mold cage 102 as shown in FIG. 10C. During this thermal forming process, sheath 112 of silicon can withstand the high temperature as it limits the forced expansion of cage 102 to a predetermined volume. With certain amount of cooling time, blown cage 102 may set its target form. FIG. 10D shows the resultant exercise ball device 100.

It is also possible to form an integral sheath over cage 102 in two steps of wrapping a liner with an inner surface for maintaining the folding movements of cage 102 and an outer grip layer molded to cage 102 through the liner. First, cage 102 is prepared to take the final form shown in FIG. 8. The liner may be a thin elastic sleeve that is tightly wrapped on cage 102, which has enough bias to retain its shape overcoming the sheath enclosure.

A wide variety of plastic construction methods are available for constructing the sheath enclosure. One such method is to form the sheet as a flat sheet and thermoform the sheet over a mold.

A mold is prepared to form a durable outer layer. Into the mold cavity, cage 102 is introduced and suspended by lateral openings 107 held and blocked by the mold wall areas to limit the resin from entering inside of the cage 12. Then, with injection of silicon or other resin and upon curing of the resin in the mold the cage 12 coated by the thin stretched elastic skin may be retrieved for the next step. This second layer may have a surface pattern transferred from the mold to the resultant outer skin of finished ball in order to give the necessary grip for the exerciser's hands.

Generally, a squish ball may be crushed under resistive bias through pushing away internally capsized air or yielding deformation of a semisolid foundation material like an elastic foam or jelly. However, in this invention, the thin and light cages described are formed to simulate the crushing effect of conventional grip exercisers. Different from conventional grip exercisers, the squish ball 10, 100 of the present invention looks like ordinary spherical or ovoid balls and one can easily immerse ones self in grip exercising while watching a game using that respective ball. Because the present invention ball 10, 100 itself has a very low mass throwing it to others is not harmful physically.

Therefore, while the presently preferred form of the crush ball has been shown and described, and several modifications thereof discussed, persons skilled in this art will readily appreciate that various additional changes and modifications may be made without departing from the spirit of the invention, as defined and differentiated by the following claims.

The invention claimed is:

1. A resistive ball for resistance exercise comprising:

a flexible sheet having a curled portion and a broken edge for allowing sliding contraction of the flexible sheet under hand grip bias, wherein the flexible sheet has two free ends extending substantially half the circumference of the ball and wherein the two free ends slide over each other, wherein the flexible sheet is formed into a closed shape;

two lateral apertures located at opposite ends of the free ends to permit an uninterrupted collapse of the sheet in sliding contraction; and a sheath for enveloping the sheet to provide a continuous slip resistant exterior surface for grasping the ball.

2. The resistive ball of claim 1, wherein the two free ends are positioned diametrically opposite locations on the ball.

3. The resistive ball of claim 1, wherein the sheet has two hemispherical sections and a bridge for internally joining the hemispherical sections.

4. The resistive ball of claim 3, wherein the closed shape of the sheet is spherical.

5. The resistive ball of claim 3, wherein the closed shape of the sheet is ovoid.

6. The resistive ball of claim 1, wherein the two free ends are overlapped over a predetermined circumferential area of the ball and have a common flex area in between the free ends.

7. The resistive ball of claim 6, wherein the closed shape of the sheet is spherical.

8. The resistive ball of claim 6, wherein the closed shape of the sheet is ovoid.

9. The resistive ball of claim 1, further comprising a tracking means having a number of grooves extending circumferentially and internally of the sheet from an outer one of the free ends down to the bottom of the sheet and elongated raised treads near the other inner free end for mating with the grooves so that the treads may follow the grooves in linear fashion to guide the ball contract and expand in straight response to gripping forces.

10. The resistive ball of claim 1, wherein the sheet is made at least partially of steel.

11. The resistive ball of claim 1, wherein the sheath is made of heat resistant silicon.

* * * * *